US008232498B2

(12) United States Patent
Gentsch

(10) Patent No.: US 8,232,498 B2
(45) Date of Patent: Jul. 31, 2012

(54) SHORT-CIRCUIT DEVICE FOR MEDIUM AND HIGH-VOLTAGE SWITCHING DEVICES

(75) Inventor: Dietmar Gentsch, Ratingen (DE)

(73) Assignee: ABB Technology AG, Zurich (CH)

( * ) Notice: Subject to any disclaimer, the term of this patent is extended or adjusted under 35 U.S.C. 154(b) by 410 days.

(21) Appl. No.: 12/641,950

(22) Filed: Dec. 18, 2009

(65) Prior Publication Data

US 2010/0155371 A1 Jun. 24, 2010

(30) Foreign Application Priority Data

Dec. 18, 2008 (EP) ..... 08021977

(51) Int. Cl.
*H01H 37/44* (2006.01)

(52) U.S. Cl. ..... 218/92; 307/157; 307/401

(58) Field of Classification Search ..... 218/7, 10, 218/92, 93, 121–126, 146; 337/30, 114, 337/157, 401–405
See application file for complete search history.

(56) References Cited

U.S. PATENT DOCUMENTS

| | | | | |
|---|---|---|---|---|
| 4,224,491 | A | 9/1980 | Kroon | |
| 4,527,025 | A * | 7/1985 | Patrichi et al. | 200/61.08 |
| 7,772,958 | B2 * | 8/2010 | Schlotzer | 337/157 |
| 2010/0219162 | A1 * | 9/2010 | Gentsch | 218/121 |

FOREIGN PATENT DOCUMENTS

| | | |
|---|---|---|
| DE | 94 19 141 U1 | 5/1996 |
| DE | 102 54 497 B3 | 6/2004 |

OTHER PUBLICATIONS

European Search Report dated May 28, 2009.

* cited by examiner

*Primary Examiner* — Renee S Luebke
*Assistant Examiner* — Marina Fishman
(74) *Attorney, Agent, or Firm* — Buchanan Ingersoll & Rooney PC

(57) ABSTRACT

A short-circuit device is provided for medium and high-voltage switching devices, in which at least one moving contact is moved onto a fixed contact by means of a propelling charge. Two contact arrangements are provided in series to provide a higher dielectric strength. Each of the contact arrangements includes a fixed contact and a moving contact. A first fixed contact of a first one of the contact arrangements contains a mechanical ignition device for providing a propelling charge to a moving contact of the second one of the contact arrangements, such that when the moving contact reaches the fixed contact of the first contact arrangement, the propelling charge is mechanically ignited to cause the moving contact of the second contact arrangement to be propelled toward the fixed contact of the second contact arrangement.

20 Claims, 1 Drawing Sheet

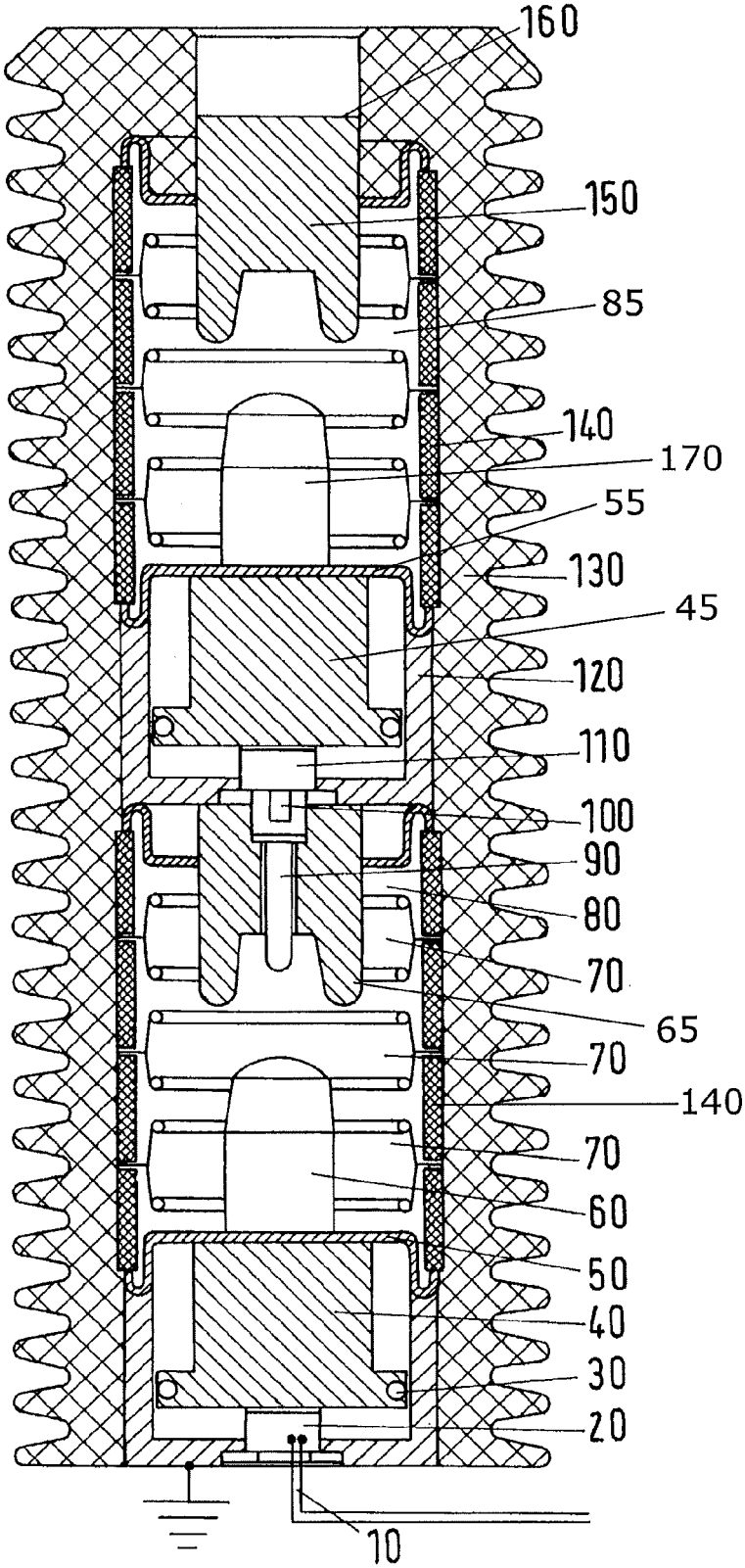
160
150
85
140
170
55
130
45
120
110
100
90
80
70
65
70
140
70
60
50
40
30
20
10

SHORT-CIRCUIT DEVICE FOR MEDIUM AND HIGH-VOLTAGE SWITCHING DEVICES

RELATED APPLICATION

This application claims priority under 35 U.S.C. §119 to European Patent Application No. 08021977.7 filed in Europe on Dec. 18, 2008, the entire content of which is hereby incorporated by reference in its entirety.

FIELD

The present disclosure relates to a short-circuit device for medium and high-voltage switching devices, in which at least one moving contact is moved onto a fixed contact by means of a propelling charge.

A short-circuit device has been disclosed in DE 102 54 497 B3 in which a propelling charge is provided for moving the moving contact. An effective and mechanically fast contact closure can be achieved in this way.

SUMMARY

An exemplary embodiment provides a short-circuit device comprising a first contact arrangement, which includes a first moving contact, a first fixed contact, and a mechanical ignition device configured to provide a propelling charge when the first moving contact comes into contact with the first fixed contact. The exemplary short-circuit device also comprises a second contact arrangement arranged in series with the first contact arrangement, the second contact arrangement including a second moving contact and a second fixed contact. When the first moving contact comes into contact with the first fixed contact, the mechanical ignition device of the first contact arrangement is configured to mechanically ignite the propelling charge and cause the second moving contact to be propelled toward the second fixed contact.

BRIEF DESCRIPTION OF THE DRAWINGS

Additional refinements, advantages and features of the present disclosure are described in more detail below with reference to exemplary embodiments illustrated in the drawings, in which:

FIG. 1 illustrates a sectional view of an exemplary cascade short-circuit device constituting an example of a short-circuit device according to at least one embodiment of the present disclosure.

DETAILED DESCRIPTION

Exemplary embodiments of the present disclosure provide a short-circuit device having a high dielectric strength.

According to an exemplary embodiment of the present disclosure, a short-circuit device comprises two contact arrangements connected in series, wherein a fixed contact and a moving contact are respectively provided in each one of the contact arrangements, such that a first contact arrangement includes a first moving contact and a first fixed contact, and a second contact arrangement includes a second moving contact and a second fixed contact. The first moving contact is caused to come into contact with the first fixed contact. The first fixed contact contains a mechanical ignition device that provides a propelling charge for the second moving contact of the second contact arrangement such that when the first moving contact reaches the first fixed contact of the first contact arrangement, a propelling charge is mechanically ignited for the second moving contact. This mechanically forces a successive sequence of firing of the propelling charges that is achieved in a reliable manner.

According to this exemplary embodiment, a high dielectric strength is achieved by spreading the short-circuit device across two contacts in series.

An exemplary embodiment provides that each moving contact is connected to a piston-cylinder unit in which one or more propelling charges are arranged. This feature provides a reliable operational implementation of the stated functional requirement.

An exemplary embodiment provides that a gas-tight membrane, which is punctured by the piston at intended breakpoints when the propelling charge is ignited, is provided between piston and contact piece. This feature makes it possible to design the remaining part of the contact area in the form of a vacuum chamber, for example.

An exemplary embodiment provides that at least the chambers in which the switching path lies can be vacuum chambers, for example.

An exemplary embodiment provides that in each contact arrangement, a plurality of metallic screen elements, which are each separated from one another by a gap, are provided around each moving contact along a switching path.

An exemplary embodiment provides that the moving contacts can be designed with a conical shape and that the respective fixed contacts can be provided with an inner cone in a complimentary manner. This feature provides a large-area contact for the contact surfaces.

An exemplary embodiment provides that the series-connected switches can be arranged in a common insulation-encapsulated housing.

An exemplary embodiment of a short-circuit device is shown in FIG. 1, which illustrates a sectional view of a cascade short-circuit device as an example of a short-circuit device according to the present disclosure. A moving contact 60 and a fixed contact 65 are illustrated in the lower part of FIG. 1 as component elements of a first contact arrangement. A moving contact 170 and a fixed contact 150 are illustrated in the upper part of FIG. 1 as component elements of a second contact arrangement. In the exemplary embodiment of FIG. 1, contacts 60, 65 are arranged in a first vacuum chamber 80, and contacts 170, 150 are arranged in a second vacuum chamber 85.

In the exemplary embodiment illustrated in FIG. 1, the moving contact 60 can be driven by means of a propelling charge 20. The propelling charge 20 can be ignited via an electrical priming charge 10, for example. When the propelling charge 20 is ignited, the moving contact 60 is propelled toward and comes into contact with the fixed contact 65. According to the exemplary embodiment illustrated in FIG. 1, the propelling charge 20, when ignited, activates a piston 40, which penetrates the intended break line and/or breakpoints of a membrane 50 and moves the moving contact 60 toward the fixed contact 60. According to an exemplary embodiment, the membrane 50 can be a gas-tight membrane that is punctured by the piston 40 at intended break points when the propelling charge 20 is ignited to propel movement of the piston 40 in the direction of the fixed contact 65. A mechanical firing pin 90 is actuated when the first moving contact 60 reaches the fixed contact 65. When actuated, the firing pin 90 ignites an impact igniter 100 of a second propelling charge 110.

Similar to the first contact arrangement, a piston 45 is activated and propelled in the direction of the second fixed contact 150 when the second propelling charge 110 is ignited. The piston 45, upon being activated, penetrates the intended break line and/or break points of a membrane 55 and causes the second moving contact 170 to be propelled and move toward the opposing second fixed contact 150 until the second moving contact also closes at the second fixed contact 150. In both cases of the first and second contact arrangements, current can be transmitted by means of conductor lines 140 and/or sliding contacts 30 on the respective pistons 40, 45 and the respective moving contacts 60, 170. The pistons 40, 45 are configured to move within a respective cylinder 120, as shown in FIG. 1.

In the exemplary embodiment illustrated in FIG. 1, the first pair of moving and fixed contacts 60, 65 are arranged in a separate vacuum chamber 80, and the second pair of moving and fixed contacts 170, 150 are arranged in a another separate vacuum chamber 85.

Alternatively, all contact pairs can be arranged in a common vacuum chamber, and the common vacuum chamber can be divided into different sub-chambers separated by membranes 50, 55, for example.

A plurality of screens 70, each separated from one another by an air gap, can be arranged in a substantially linear arrangement along both switching paths.

Overall, this results in a design of short-circuit device in which a high dielectric strength is achieved, because the voltage is divided between two switching sub-sections, i.e., the first and second contact arrangements. In the exemplary embodiment illustrated in FIG. 1, the second fixed contact 160 has a connection surface 160. According to an exemplary configuration, the connection surface 160 can be arranged in contact with an electrically conductive conduit, such as wiring, for example, to transmit current carried in the switching arrangement to the conduit. FIG. 1 illustrates an exemplary embodiment in which two contact arrangements are provided. The present disclosure is not limited thereto. Additional contact arrangements can be provided in series to the two contact arrangements illustrated in FIG. 1.

FIG. 1 illustrates an exemplary configuration in which the entirety of the constituent elements are enclosed by a contiguous insulation body 130. Alternatively, the system can work without an insulation body when an insulating gas is provided as an environmental medium.

In the exemplary embodiment of FIG. 1, the moving contacts 60, 170 are provided with a conical shape, and the respective fixed contacts 65, 150 are provided with an inner cone in a complimentary manner to the moving contacts. The complimentary shapes of the moving and fixed contacts can provide a large-area contact for the contact surfaces. However, it is to be understood that the present disclosure is not limited to the illustrated embodiment, as the respective pairs of moving and fixed contacts can be provided with complimentary shaped surfaces to achieve suitable contact surfaces to achieve the effects of the present disclosure. Furthermore, the respective contact pairs of the series-arranged contact arrangements can be provided with different shaped surfaces relative to each other.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCES

10 Electrical priming charge
20 Propelling charge
30 Current transition
40 Piston
45 Piston
50 Membrane with intended break point
55 Membrane with intended break point
60 Moving contact piece
65 Fixed contact
70 Multiple screens
80 Vacuum chamber
90 Mechanical firing pin
100 Impact igniter
110 Propelling charge
120 Cylinder
130 Insulation
140 Conductor lines
150 Fixed contact
160 Connection surface
170 Moving contact piece

What is claimed is:

1. A short-circuit device comprising:

a first contact arrangement including a first moving contact, a first fixed contact, and a mechanical ignition device configured to provide a propelling charge when the first moving contact comes into contact with the first fixed contact; and a second contact arrangement arranged in series with the first contact arrangement, the second contact arrangement including a second moving contact and a second fixed contact, wherein when the first moving contact comes into contact with the first fixed contact, the mechanical ignition device of the first contact arrangement is configured to mechanically ignite the propelling charge and cause the second moving contact to be propelled toward the second fixed contact.

2. The short-circuit device as claimed in claim 1, wherein each moving contact is connected to a piston-cylinder unit in which one or more propelling charges are arranged.

3. The short-circuit device as claimed in claim 2, comprising a gas-tight membrane, which is punctured by the piston at intended breakpoints when the propelling charge is ignited, between each piston and a corresponding one of the moving contacts.

4. The short-circuit device as claimed in claim 1, wherein the first and second contact arrangements are arranged in a plurality of chambers in which a switching path of the first and second contact arrangements lies.

5. The short-circuit device as claimed in claim 4, comprising a plurality of metallic screen elements, which are each separated from one another by a gap, arranged around each moving contact along the switching path.

6. The short-circuit device as claimed in claim 1, wherein at least one of the moving contacts is designed with a conical shape, and the fixed contact corresponding to the at least one moving contact is provided with an inner cone in a complimentary manner to the conical shape of the corresponding moving contact.

7. The short-circuit device as claimed in claim 1, wherein the series-connected contact arrangements are arranged in a common insulation-encapsulated housing.

8. The short-circuit device as claimed in claim 4, wherein the chambers are vacuum chambers.

9. The short-circuit device as claimed in claim 1, comprising a plurality of metallic screen elements, which are each separated from one another by a gap, arranged along a switching path between the first and second contact arrangements.

10. The short-circuit device as claimed in claim 4, wherein the first and second moving contacts comprise a conically shaped surface that comes into contact with the first and second fixed contacts, respectively, and the first and second fixed contacts comprise an inwardly shaped coned surface complimentary to the conically shaped surface of the first and second moving contacts, respectively.

11. The short-circuit device as claimed in claim 1, comprising:

a first piston-cylinder unit connected to the first moving contact and including a first cylinder, a first piston configured to move within the first cylinder, and a first propelling charge; and a second piston-cylinder unit connected to the second moving contact and including a second cylinder, a second piston configured to move within the second cylinder, and a second propelling charge.

12. The short-circuit device as claimed in claim 11, wherein the mechanical ignition device of the first contact arrangement is configured to ignite the second propelling charge of the second piston-cylinder unit when the first moving contact comes into contact with the first fixed contact.

13. The short-circuit device as claimed in claim 12, wherein the second piston is configured to be activated by the ignition of the second propelling charge and cause the second moving contact to be propelled toward the second fixed contact.

14. The short-circuit device as claimed in claim 13, comprising a membrane arranged between the second piston and the second moving contact, the membrane having intended breakpoints, wherein the second piston is configured to penetrate through the intended breakpoints of the membrane when activated by the ignition of the second propelling charge and cause the second moving contact to be propelled toward the second fixed contact.

15. The short-circuit device as claimed in claim 11, comprising a priming device configured to ignite the first propelling charge of the first piston-cylinder unit and activate the first piston, wherein the first piston is configured to cause the first moving contact to propel toward the first fixed contact when the first piston is activated by the ignition of the first propelling charge.

16. The short-circuit device as claimed in claim 15, comprising a membrane arranged between the first piston and the first moving contact, the membrane having intended breakpoints, wherein the first piston is configured to penetrate through the intended breakpoints of the membrane when activated by the ignition of the first propelling charge and cause the first moving contact to be propelled toward the first fixed contact.

17. The short-circuit device as claimed in claim 11, comprising a first membrane arranged between the first moving contact and the first piston-cylinder unit, and a second membrane arranged between the second moving contact and the second piston-cylinder unit, the first and second membranes having intended breakpoints, respectively.

18. The short-circuit device as claimed in claim 17, comprising an insulation body configured to enclose the first and second membranes, wherein the first and second membranes divide the first and second contact arrangements into separate chambers within the insulation body.

19. The short-circuit device as claimed in claim 17, comprising a priming device configured to ignite the first propelling charge of the first piston-cylinder unit and activate the first piston, wherein:

the first piston is configured to penetrate through the intended breakpoints of the first membrane when activated by the ignition of the first propelling charge and cause the first moving contact to come into contact with the first fixed contact;

the mechanical ignition device of the first contact arrangement is configured to ignite the second propelling charge and activate the second piston of the second piston-cylinder unit when the first moving contact comes into contact with the first fixed contact; and the second piston is configured to penetrate through the intended breakpoints of the second membrane when activated by the ignition of the second propelling charge and cause the second moving contact to come into contact with the second fixed contact.

20. The short-circuit device as claimed in claim 19, wherein the first and second membranes are gas-tight.

* * * * *